US006619492B2

(12) United States Patent
Battegazzore

(10) Patent No.: US 6,619,492 B2
(45) Date of Patent: Sep. 16, 2003

(54) SECURITY CLOSURE FOR BOTTLES OF LIQUOR AND THE LIKE

(75) Inventor: Piero Battegazzore, Alessandria (IT)

(73) Assignee: Guala Closures S.p.A. (IT)

( * ) Notice: Subject to any disclaimer, the term of this patent is extended or adjusted under 35 U.S.C. 154(b) by 0 days.

(21) Appl. No.: 10/226,548

(22) Filed: Aug. 23, 2002

(65) Prior Publication Data

US 2003/0000908 A1 Jan. 2, 2003

Related U.S. Application Data

(63) Continuation of application No. PCT/EP01/01969, filed on Feb. 21, 2001.

(30) Foreign Application Priority Data

Feb. 28, 2000 (EP) ..... 00830142

(51) Int. Cl.[7] ..... B65D 49/04

(52) U.S. Cl. ..... 215/21; 215/28; 215/252; 215/321; 222/152.1; 222/153.09; 222/541.5

(58) Field of Search ..... 215/21, 28, 252, 215/312; 222/153.09, 153.01, 541.5; 265/321

(56) References Cited

U.S. PATENT DOCUMENTS 3,850,328 A * 11/1974 Guala ..... 215/252
4,382,520 A * 5/1983 Aleff ..... 215/21
4,458,817 A * 7/1984 Guala ..... 215/21
4,700,859 A 10/1987 Gregory ..... 215/252
5,131,549 A * 7/1992 Battegazzore ..... 215/252
5,246,124 A * 9/1993 Battegazzore ..... 215/251
5,611,443 A * 3/1997 King ..... 215/220
5,740,932 A * 4/1998 Battegazzore ..... 215/252
6,276,544 B1 * 8/2001 Battegazzore ..... 215/252
6,454,126 B1 * 9/2002 Battegazzore ..... 222/23

FOREIGN PATENT DOCUMENTS

GB 2302867 2/1997
WO 9601216 1/1996

* cited by examiner

*Primary Examiner*—Nathan J. Newhouse
*Assistant Examiner*—James Smalley
(74) *Attorney, Agent, or Firm*—Ostrolenk, Faber, Gerb & Soffen, LLP

(57) ABSTRACT

The present invention relates to a security closure for bottles for liquor and the like having a neck, comprising a stopper cap having an end wall, a skirt, and a longitudinal axis X—X perpendicular to said end wall of the stopper cap, a security seal attached to said skirt, a groove in the outer surface of said neck axially positioned onto said neck, said sleeve being provided with an upper edge and said upper edge snap-fitting into said groove of the neck, stop means on said skirt radially extending towards said longitudinal axis X—X, said stop means providing a bearing surface for an abutment present on said sleeve.

16 Claims, 2 Drawing Sheets

SECURITY CLOSURE FOR BOTTLES OF LIQUOR AND THE LIKE

CROSS REFERENCE TO RELATED APPLICATION

This is a continuation application of PCT/EP01/01969 filed Feb. 21, 2001, which PCT application claims priority of European patent application number 00830142.6 filed Feb. 28, 2000, herein incorporated by reference.

FIELD OF THE INVENTION

The present invention relates to a security closure for bottles of liquor and the like, that comprises a stopper cap having an end wall and a skirt with a security seal, and a sleeve that screws into the said stopper cap and fits onto a neck of a bottle.

BACKGROUND OF THE INVENTION

Security closures for bottles of liquor and the like of this kind are known and are in wide use.

These closures are produced with all their components assembled in one piece which is then fitted directly to the neck of a bottle.

More specifically, after inserting an inner cap inside the stopper cap in such a way that it is held against the end wall of the stopper cap, the sleeve is screwed into the inner wall of the skirt of the stopper cap by engagement between a thread on this inner wall and a corresponding thread on the outer wall of the said sleeve.

Thus assembled, the cap is now fitted to the neck of a bottle in such a way that a snap engagement occurs between the above mentioned sleeve and the neck of the bottle.

More precisely, the snap engagement is caused by an edge of the sleeve being pushed over a ramp formed on the neck of the bottle and into a groove.

By this means the sleeve is fixed non-removably to the neck of the bottle, while the threaded engagement between this sleeve and the stopper cap allows the stopper cap to be unscrewed and rescrewed onto the neck of the bottle.

However, there is one major disadvantage with this product.

The force necessary to pass over the above mentioned ramp and bring about the snap engagement during the application of the closure to a bottle is about 70 kg. This force is taken directly by the sleeve which, being screwed to the skirt of the stopper cap, passes this force on through the threaded engagement between the respective threads of the sleeve and skirt.

This threaded engagement does not however provide satisfactory resistance to this force and the result is that the threads are either stripped or at least forced.

There is therefore a felt need to provide a security closure for bottles of liquors and the like that can be applied easily and securely to a bottle.

The problem addressed by the present invention is therefore that of devising a security closure for bottles of liquors and the like, whose structural and functional characteristics will be such as to satisfy the above mentioned requirements and at the same time overcome the problems presented by security closures of the prior art.

SUMMARY OF THE INVENTION

This problem is solved with a security closure in accordance with the main claim.

BRIEF DESCRIPTION OF THE DRAWINGS

Other characteristics and advantages of the security closure for bottles of liquor and the like in accordance with this invention will be found in the description given below of a preferred embodiment, provided by way of non-restrictive indication, with reference to the accompanying figures, in which.

DETAILED DESCRIPTION OF THE PREFERRED EMBODIMENTS

Figure 1:
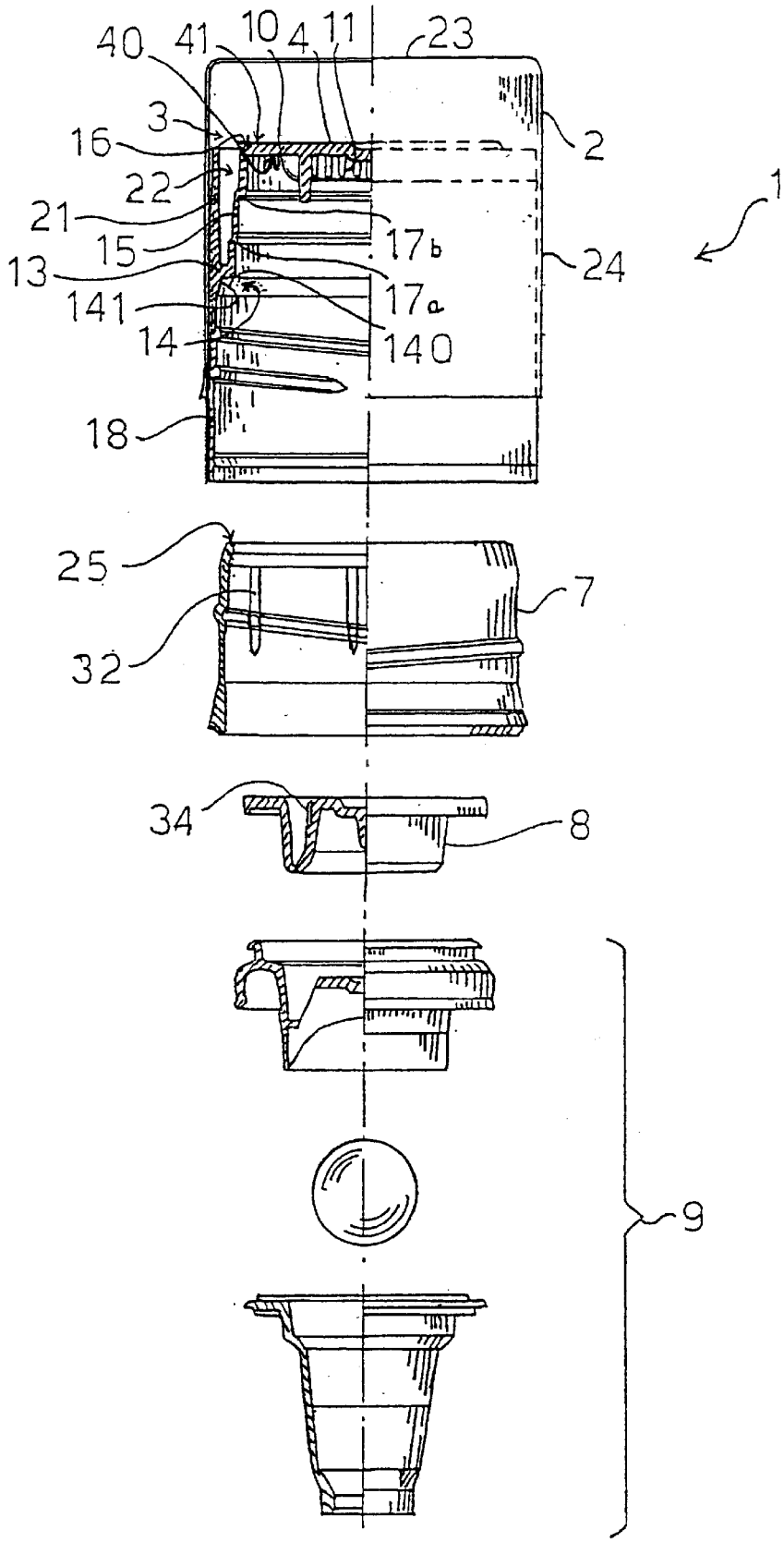
FIG. 1 is an exploded view in partial section of a security closure according to the invention.

Referring to the accompanying figures, the number 1 is a general reference for a security closure for a bottle of liquor or the like.

The closure 1 comprises an outer cover 2, a stopper cap 3 with an end wall 4 and a skirt 5, a security seal 6, a sleeve 7, an inner cap 8 and valve parts 9.

The end wall 4 is a disc having a substantially flat outer surface 40 and an inner surface 41 that possesses means for fixing it to the inner cap 8.

To be specific, these means consist of a ring 10 projecting from the inner surface 41 of the end wall 4 towards the interior of the cap 3, the said ring having an internal profile 11 of grooves and axial teeth.

The skirt 5 consists of a hollow cylinder extending from the end wall 4 of the cap 3 parallel with an axis X—X perpendicular to the plane of the end wall for a defined length towards a free end 12.

In addition the skirt 5 has a shoulder stop means 13 comprising a projection projecting towards the axis X—X. In particular, the projection is a shoulder designed to abut against the sleeve 7 when the sleeve is engaged coaxially inside the skirt.

These stop means 13 are preferably a step profile on the inner surface of the skirt 5 producing a rise 14 substantially perpendicular to the inner surface of the skirt.

In particular, said rise 14 constitutes an abutting surface against which the sleeve 7 can stop, as will be described in detail later.

From the remote end 140 of the rise 14 with respect to the inner surface of the skirt 5, an upward portion 15 of the skirt 5 runs parallel to the axis X—X and joins the end wall 4 via a connecting edge 16.

The said connecting edge 16 is also the radial abutment of the end wall 4 of the stopper cap 3.

Preferably, furthermore, as shown in the drawings of the illustrative embodiment of the invention, the upper portion 15 includes an inward projection 17*a* and another step profile 17*b*.

Meanwhile, from the near end 141 of the rise 14 (with respect to the inner surface of the skirt 5 there extends, however, a lower portion 18 of the skirt 5, likewise parallel to the axis X—X but in the opposite direction to the upper portion 15.

From the above description, and with particular reference to the drawings, it will therefore be seen that the skirt 5 is composed of an upper portion 15 of smaller diameter than a lower portion 18.

The inner surface of said lower portion 18 is threaded 19.

Also, the security seal 6 is attached to the free end 12 of the skirt 5 by means of bridges 20 that break when the bottle is first opened.

Also extending from the near end 141 of the rise 14, towards the end wall 4 of the stopper cap 3, and parallel with the upper portion 15 of the skirt 5, are elastic means 21.

In particular, in the example shown, said elastic means 21 are an annular band concentric with the upper portion 15 of the skirt 5 but separated from it by a annular gap 22.

This annular gap has the function of allowing the annular band 21 to flex radially towards the axis X—X, thus initially facilitating the fitting of the cover 2 over the stopper cap 3 and then keeping said cover in place by means of the interference between the outer surface of the annular band 21 and the inner surface of the cover 2.

More precisely, the cover 2 comprises a generally flat disc-shaped end wall 23 and a hollow cylindrical skirt 24 that extends parallel with the axis X—X, coinciding with that of the skirt 5 of the stopper cap 3, in such a way as to end approximately flush with the free end 12.

The skirt 24 of the cover 2 has a diameter such that it fits exactly around the skirt 5 of the stopper cap 3.

The generally cylindrical sleeve 7 has an axis coinciding with the axis X—X of the stopper cap 3 and has an upper edge 25 and a lower edge 26.

The upper edge 25 forms an abutment which will provide the above mentioned bearing surface for the rise 14 of the skirt 5 of the stopper cap 3.

In particular, the upper edge 25 forms a flanged upper surface that extends inwards approximately at right angles to the axis X—X.

Simultaneously, moreover, this upper edge 25 is designed to snap-engage removably into a groove 27 in the outer surface of the neck 28 of a bottle.

Figure 2:
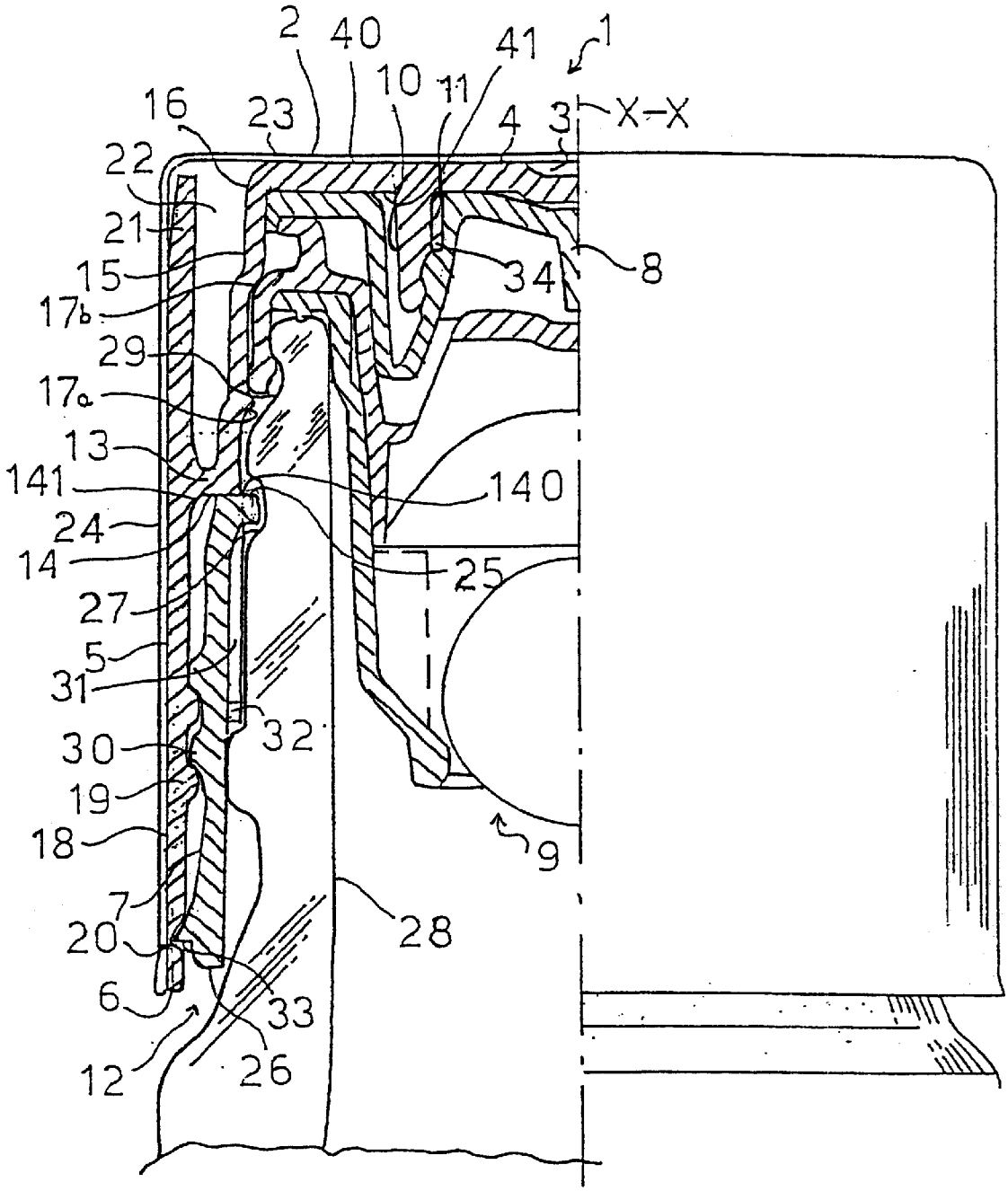
FIG. 2 is a view in partial section of the device shown in FIG. 1 assembled in its position of use.

In detail, when the sleeve 7 is fitted to the neck 28 of a bottle as described later, its upper edge 25 is forced over a ramp 29 formed on the neck 28 near its upper edge and into the groove 27, as shown in FIG. 2.

Said sleeve 7 has an external thread 30 for screwing into the corresponding thread 19 present on the inner surface of the skirt 5 of the stopper cap 3.

On the inside, meanwhile, the sleeve 7 has teeth 31 running in an axial direction for abutting against corresponding projections 32 provided on the neck of the bottle in order to prevent the sleeve 7 from being rotated relative to the neck 28 of the bottle.

Close to the lower edge 26, the sleeve 7 flares outwards slightly and its outer surface exhibits a projection 33 which is used as a stop to prevent axial movement of the seal 6 when the bottle is opened for the first time, before the bridges 20 break.

The inner cap 8 is of conventional type and will not be described here in detail.

More specifically, the above mentioned inner cap is fitted to the end wall 4 of the stopper cap 3 by means of a grooved profile 34 as it provides a form fit with the corresponding grooved profile 11 of the end wall 4.

The security closure 1 also includes valve parts 9, of conventional type, contained releasably in the interior of the stopper cap 3.

These valve parts 9 are there to prevent filling of a bottle, while allowing a liquid contained in the bottle to be poured out.

The security closure according to the present invention is assembled to form a one-piece item that can be handled on its own in the manner described below.

First of all the inner cap 8 is inserted into the stopper cap 3 and engaged securely with the end wall 4 as described earlier.

Next, the valve means 9 are inserted into the stopper cap 3 and held there releasably by their engagement with the above mentioned projection 17*a* and step profile 17*b*.

The sleeve 7 is now screwed into the stopper cap 3 until the upper edge 25 of this sleeve abuts against the rise 14 of the step profile on the inside of the skirt 5.

The security closure 1, having thus been assembled, is now ready to be fitted to the neck 28 of a bottle.

The above mentioned closure is press-fitted onto the said neck 28 as far as the point at which the upper edge 25 of the sleeve 7 snaps into engagement in the grove 27 of this neck.

To bring about the snap engagement, the upper edge 25 of the sleeve 7 must deform elastically to pass over the ramp 29 formed near the upper edge of the neck 28.

Once the upper edge 25 of the sleeve 7 has engaged in the groove 27, as illustrated in FIG. 2, the sleeve 7 cannot be removed from around the neck 28 of the bottle.

Furthermore, the valve parts 9 lock onto the neck 28 of a bottle and remain fixed to it when the said bottle is opened for the first time.

The advantage of using the security closure according to the invention is that the pressure required to snap the sleeve 7 into position on the neck 28 of the bottle can be applied without running the significant risk of stripping or at least forcing the thread formerly used to screw the sleeve 7 to the stopper cap 3.

This is explained by the fact that the stop means 13 perform a special function of providing resistance to the above mentioned pressure.

Another advantageous aspect of the closure according to the invention is that of giving excellent centring of the stopper cap 3 on the neck 28 when the stopper cap needs to be screwed back onto the bottle, as the narrower upper portion 15 of the skirt 5 sits more or less exactly on the end of the bottle neck 28.

Another advantage of using the security closure according to the invention is that a decorative outer cover 2 can be non-removably mounted on the stopper cap 3 because the elastic means 21 of the skirt 5 are able to flex slightly towards the axis X—X and allow the cover 2 to be fitted over the stopper cap 3.

The subsequent elastic return of these elastic means 21 to the rest position allows the said parts to grip the inner wall of the cover 2 by slight interference. As a result, the cover 2 and the stopper cap 3 will be more or less firmly held together.

The security closure of the invention is capable of many variants.

In particular, the stop means 13 may take the form of a simple projection on the inner surface of the skirt of the stopper cap, in which case the upper portion 15 of the skirt 5 will coincide with the annular band 21 and the end wall 4 of the stopper cap 3 will be joined directly to the said upper portion.

The valve parts 9 may also be absent, and the inner cap 8 may be modified to make a seal on the inner wall of the neck 28 of the bottle.

The respective threads of the sleeve 7 and of the skirt 5 may be single-start or multistart.

The skirt 24 of the cover 2 may be extended so as to project slightly from the free end 12 of the skirt 5 of the stopper cap 3.

The outer cover 2 may be decorated as desired with colour, designs and/or inscriptions.

The shapes and/or dimensions of the components of the closure described above may be modified for particular requirements or preferences.

Likewise the materials employed may differ to suit particular conditions.

As can be appreciated from the above account, the security closure according to the invention satisfies the needs referred to in the introductory part of this description and at the same time overcomes the difficulties presented by the security closures of the prior art.

In essence, then, the present invention is a security closure for liquors and the like that can be fitted to bottles easily and without difficulty.

Clearly, in order to satisfy particular and specific requirements, the person skilled in the art could make numerous modifications and alterations to the security closure for liquors and the like described above, all such modifications and alterations remaining within the scope of the invention as defined in the following claims.

What is claimed is:

1. A security closure for a bottle having a neck with a ramp having a minimum external diameter and a maximum external diameter, the minimum external diameter of the ramp being closer to an opening at the top of the neck of the bottle, the security closure comprising a stopper cap having an end wall, a stop connected to said end wall, a skirt attached to said end wall by said stop and longitudinal axis X—X perpendicular to said end wall of the stopper cap, said skirt extending from said stop parallel to said longitudinal axis X—X; a security seal attached to said skirt; and an inner sleeve having an upper edge, said upper edge having an inner diameter selected to be in a range between the minimum external diameter and the maximum external diameter of the ramp of the neck of the bottle, and said upper edge snap-fitting over said ramp of said neck of said bottle, said stop attached to said skirt radially extending towards said longitudinal axis X—X and abutting said upper edge of said sleeve.

2. The security closure according to claim 1, wherein the said stop comprises an annular step.

3. The security closure according to claim 2, wherein said upper edge further comprises a shoulder, said annular step abutting said shoulder of said upper edge of said sleeve.

4. The security closure according to claim 1, wherein said stop further comprises a rise, said rise extending perpendicular to said longitudinal axis X—X.

5. The security closure according to claim 4, wherein said rise is annular.

6. A security closure for bottles having a neck, said neck having a groove in an outer surface of said neck, the security closure comprising: a stopper cap having an end wall and a skirt attached to said end wall by an annular step, said skirt extending downward over said neck of said bottle; a security seal attached to said skirt; and a sleeve having an upper edge shape-fitted into said groove and abutting said shoulder; and at least one elastic element attached to a shoulder and extending upward towards said end wall of said stopper cap.

7. The security closure according to claim 6, wherein said elastic elements are flexible and reach substantially the same plane as that defined by said end wall.

8. The security closure according to claim 1, wherein said stopper cap further comprises valve parts that fit into said neck of said bottle.

9. The security closure according to claim 6, further comprising an outer cover designed to be fitted over said stopper cap, and said cover is held firmly on said stopper.

10. A security closure for bottles having a neck with an external annular groove, said closure comprising a stopper cap having an end wall, a longitudinal axis X—X perpendicular to said end wall, a skirt connected to said end wall and extending from said end wall parallel to said longitudinal axis X—X to a lower edge and having an outer surface and an inner surface, and the inner surface is threaded; an annular security seal attached axially to said lower edge of the skirt by a breakable structure; a sleeve axially fitted onto said neck, said sleeve having an outer surface facing said skirt and an inner surface opposite of the outer surface and said outer surface of the sleeve is threaded, whereby said inner surface of the skirt and said outer surface of the sleeve are threadably engageable, said sleeve further comprising an upper edge at one end of the sleeve, said upper edge including an inwardly extending flange portion, said flange portion snap-fitting into said groove of said neck of said bottle, and a lower edge of an opposite end of said sleeve including a radial projection for preventing axial movement of said seal whereby when opening said closure for the first time said breakable structure is broken; and a stop extending radially from said inner surface of the skirt towards said longitudinal axis X—X, said stop abutting said upper edge of said sleeve when said closure is closed on said neck of said bottle.

11. The security closure according to claim 10, wherein said stop comprises an annular step.

12. The security closure according to claim 10, further comprising at least one elastic element attached to said stop and extending axially therefrom toward a plain defined by said end wall of said stopper cap, said at least one elastic element substantially reaching to the plane defined by said end wall.

13. The security closure according to claim 12, wherein said at least one elastic element is flexible.

14. The security closure according to claim 10, further comprising a valve element fitted into said neck of said bottle.

15. The security closure according to claim 10, further comprising an outer cover fitted securely over said stopper cap.

16. The security closure according to claim 12, further comprising an outer cover fitted securely over said stopper cap and said at least one elastic element.

* * * * *